United States Patent [19]

Dahlstrom

[11] 4,147,322

[45] Apr. 3, 1979

[54] MOLD ELEMENT FOR CONCRETE-CASTING

[76] Inventor: Claes-Inge S. Dahlström, Patron Lars väg 18, S-121 40 Huddinge, Sweden

[21] Appl. No.: 835,357

[22] Filed: Sep. 19, 1977

[30] Foreign Application Priority Data

Sep. 24, 1976 [SE] Sweden ..... 7610641

[51] Int. Cl.[2] ..... E04G 11/08

[52] U.S. Cl. ..... 249/40; 249/190

[58] Field of Search ..... 249/33, 34, 40, 190, 249/41–46

[56] References Cited

U.S. PATENT DOCUMENTS 3,748,806 7/1973 Talandis ..... 249/33

FOREIGN PATENT DOCUMENTS 948833 6/1974 Canada ..... 249/33

1381346 1/1975 United Kingdom ..... 249/190

*Primary Examiner*—Richard B. Lazarus

*Assistant Examiner*—John McQuade

*Attorney, Agent, or Firm*—Burton, Parker & Schramm

[57] ABSTRACT

A mold element for casting concrete walls, which comprises a mold wall strengthened by an assembly of elongate structural steels which extend substantially parallel to one another and to one edge of the mold wall, and having at least two mold beams extending transverse to the said structural steels and across the mold wall from said one edge thereof to the opposite edge, each of the mold beams being upright when the mold element is in a vertical orientation, with said one edge uppermost, to form a mold, and each mold beam having one and only one coupling point at which a stay member can be positioned to extend between the mold element and a corresponding opposed mold element to link them together to form a mold cavity between them, said coupling point of each beam being located at a position between 35% and 40% of the length of the beam from the other end thereof.

7 Claims, 2 Drawing Figures

MOLD ELEMENT FOR CONCRETE-CASTING

BACKGROUND OF THE INVENTION

This invention relates to concrete-casting and more specifically to a mold element for casting concrete.

In recent years prefabricated mold elements are widely used in the construction industry. For instance, a mold element of the type used comprises a mold panel of sheet metal having a height of 2 to 3 meters and any desired length such as 1 to 4 meters. Horizontal stiffening members are welded at equal distances one above another at the surface of the mold panel facing away from the mold cavity such as, for instance, U-beams secured with one flange to the panel whereas the other flange is free. At right angles to these U-beams, i.e. vertically when the element is mounted in position for casting, a number of mold beams are fastened to the other flange of the U-beams with equal spaces, for instance 90 mm, the bending resistance of said mold beams being calculated so that the beams will resist the lateral forces resulting from the casting and vibration of the concrete mass. The top ends of the mold beams are linked together with a distance member, and the bottom ends are fastened to a sill or block of concrete or wood which, in turn, is fastened to the floor. A plurality of stay members, such as three or four ones, are distributed along the length of the mold beams and positioned to extend between the opposed mold element to prevent bulging of the mold walls under the lateral pressure of the fluid concrete mass.

A serious disadvantage of a mold element of this known type is the need of a large number of stay bolts with nuts, and the accompanying laborious mounting and dismounting work. Another disadvantage will be seen in the cumbrious complementary work required to fill up and smooth the holes and irregularities remaining in the finished concrete wall after dismantling the mold.

An approach to solve the above problems is represented by a mold element described in the inventor's Great Britain Pat. No. 1,381,346, according to which each mold beam has two and only two coupling points at each of which a stay bolt can be positioned to extend between the two opposed mold elements to form a mold cavity between them, wherein one coupling point of each beam is located at the upper end thereof at or adjacent the upper edge of the mold wall, and the other coupling point is located at a position between $\frac{1}{4}$ and $\frac{1}{3}$ of the height of the beam from the bottom end thereof.

Thus, the mold element described in the above-mentioned Great Britain Patent presupposes the use of an upper stay bolt to take up the outward pressure of the newly cast concrete mass above the lower stay bolt. In the course of pouring the concrete mass into the mold, the initial amounts of the poured mass will only exert a quite neglectible lateral pressure on the lower free ends of the mold beams via the mold walls, and when the mold has been completely filled and the lower ends of the mold beams are subjected to the maximum lateral force which could cause the lower end of the mold beam to be bent outwards, this bending outwards will be counteracted by the pressure exerted by the poured concrete mass on the mold beam between the points of action of the two stay bolts. In this manner a self-compensating system of forces is obtained which ensures a substantial stress-relief of the mold beam as compared with a beam clamped between the extreme ends.

The mold element according to the above-mentioned British Patent has subsequently been developed to the extent that the upper stay bolt has been given the shape of a flat bar steel member acting simultaneously as a distance member of a fixed length and having an opening at each end, said flat bar steel member being with one end pivotally mounted at a mold beam of an opposed mold element already erected and adapted to be swung across the mold cavity and secured with its other end by means of a lock bolt to an upstanding lug at the mold beam of the opposed mold element. It has been found, however, that the assembling operation is associated with serious difficulties. In the course of erecting a mold element in parallel relationship and at a fixed distance from a previously erected mold element, it is lifted by means of a building crane and lowered until it reaches the cast concrete blocks or other distance members secured to the floor to define the thickness of the wall to be cast. However, the mold element suspended in the wires of the building crane will tend to swing in the long lift wires so that it will be difficult to get the holes in the lug of the opposed mold beam and the distance member in register to allow insertion of the lock bolt. In the course of dismounting the concrete mold after completed casting operation, when the lock bolts are pulled or knocked out of their engagement, they are frequently lost.

SUMMARY OF THE INVENTION

The present invention overcomes the prior problems of the above-mentioned mold element by providing a mold element each mold beam of which has one and only one coupling point at which a stay member can be positioned to extend between the mold element and a corresponding opposed mold element to link them together to form a mold cavity between them, the coupling point of each beam being located at a distance from the end of the mold beam adapted to rest on a support, which corresponds to at least $\frac{1}{3}$, preferably 35 to 40%, of the total effective height of the beams as measured from the support, i.e., the height corresponding to the level of the concrete mass cast in the mold cavity, a distance member being mounted at the other end of the mold beam to engage the upper end of the corresponding mold beam of the opposed mold element to prevent bending of the beams inward towards one another in the course of casting.

Therefore, it is an object of this invention to provide a concrete-casting mold element of a simplified construction which provides for saving of materials and mounting work.

A further object of the invention is to provide a concrete-casting mold element giving a concrete wall which requires a minimum of mending and finishing work.

Other objects of the invention will become readily apparent from the following description and accompanying drawings.

DESCRIPTION OF THE INVENTION

Figure 1:
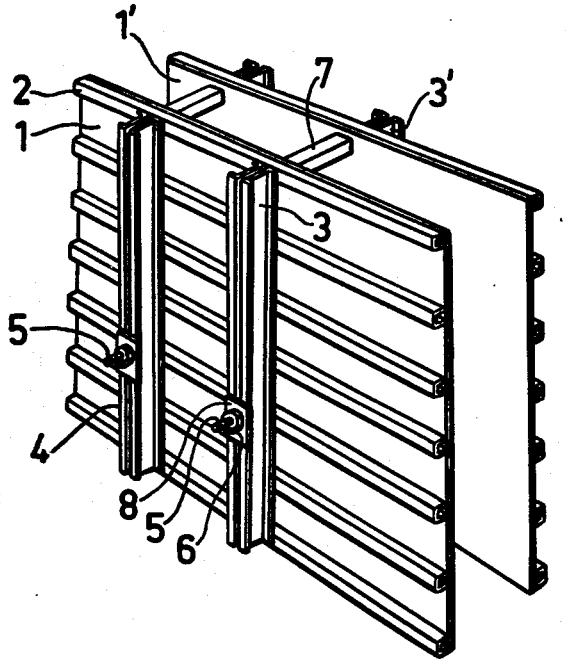
FIG. 1 shows an isometric sketch of a mold element according to the invention assembled with a similar, opposed mold element to form a mold cavity between them.

The mold element of the present invention, shown in FIG. 1, comprises a mold wall 1 strengthened in the longitudinal direction by a reinforcing structure of elongate U-irons 2, and at least two vertical mold beams 3, 4.

Each mold beam 3, 4 is provided with only one stay bolt 5 to connect the mold element with an opposed mold element 1'. The coupling point 6 of the stay bolt comprising a coupling hole is located at a distance from the lower end of the mold beam which corresponds to 35–40% of the total height of the effective height of the beam, i.e., the height to which the concrete mass is to be poured in the mold.

To prevent the opposed mold beams 3, 3' from bending inwards in the course of casting, according to the invention a distance member 7 is preferably positioned to extend across the mold cavity between the upper ends of the pair of mold beams. For example, this distance member could be a loose piece of a U-iron supported by brackets welded to the respective mold beams.

A prerequisite for casting a flat wall with the mold element according to the invention is that the vertical mold beams possess a sufficient bending strength to resist lateral pressures without appreciable bulging outwards. Whereas any standard beam material may be used such as I-irons, according to the invention a beam including two U-irons is preferably used, said beams being welded together with their webs in parallel spaced relationship at right angles to the surface of the mold wall, the width between the webs being sufficient to permit insertion of the stay member through the slot between the webs. The mold beam comprising two U-irons is strengthened, in the zone surrounding the stay member, with a steel washer 8 approximately 5 mm thick, which is welded on the outer flanges of the U-irons and has a central opening for insertion of a stay member. Such a beam provides for a good bending resistance with less height and weight than an I-iron of corresponding bending resistance.

Any suitable device may be used as the distance member between the upper ends of the mold beams, such as a wooden block. According to an embodiment of the invention, a relatively thin U-iron is welded or bolted to one of the mold beams or mold walls of a pair, at right angles to the surface of the mold wall, to rest against the opposed beam or wall to keep the correct distance between the beams when in the course of casting they tend to be bent inwards. It is also possible to weld shoulders to the upper opposed ends of the beams, on which a piece of an U-iron used as a distance member is hanged up.

It will be appreciated from the foregoing description that the essential feature of the invention resides in the positioning of the coupling point of the stay member. The practicable range of its positioning is relatively narrow. The lateral pressure of the newly cast concrete mass decreases with the height. In the initial stage of casting the concrete mass tends to bend the legs of the pair of opposed mold beams below the distance bolt outwards. However, they are prevented from this bending outwards through the upper distance member and through the stay member. The amount of this bending is about one or a few millimeters but will result in a tendency of the upper legs of the opposed mold beams to be bent inwards but are prevented from doing this by the upper distance member and the stay member by means of which the predetermined distance between the mold walls is maintained. When in the course of casting the level of concrete mass is rising and passes the stay member, the concrete mass will exert on the upstanding legs of the mold beams above the stay member an outward pressure which counteracts the inward pressure of the beam legs above the stay member caused by the outward lateral pressure of the concrete mass below the stay member.

Calculations of the moments of force exerted on the mold beams by a newly cast concrete mass have shown that the moment of force exerted by the concrete mass against the lower leg of the beam is of substantially the same magnitude as the moment of force exerted by the concrete mass against the upper leg, when the coupling point of the stay member is located at a height above the support or floor corresponding to approximately 32% of the total height of the beam. Accordingly, this means that the moments of force are in equilibrium and that on termination of the casting operation the upper legs of the pair of opposed beams would theoretically maintain their mutual distance without using distance members between the upper ends. However, it frequently occurs that the cast concrete mass will have time to set in the lower zones of the mold before casting is terminated. For that reason the lower portion of the concrete mass would no longer exert a hydraulic pressure on the lower legs, in consequence of which the upper beam legs would tend to be bent outwards in the finishing stage of casting. Therefore, the coupling point of the stay member is preferably located at a higher level of the beam than that indicated above (32% of the height), whereby the concrete mass initially cast and lying below the stay member exerts on the mold walls a lateral pressure causing the lower legs of the mold beams to be bent outwards so that the upper legs are bent inwards and forced against the distance member under a prestress which is subsequently more or less released in the course of termination of the casting when the mold is being filled with concrete mass. Therefore, according to the invention, the coupling point for the stay member is preferably located at a distance above the lower end of the mold beam which corresponds to 32–40% of the total effective height of the beam. If the coupling point would be located at a higher level than that corresponding to 40% of the total height of the beam, the inward pressure exerted on the upper beam leg would be unreasonably high.

Figure 2:
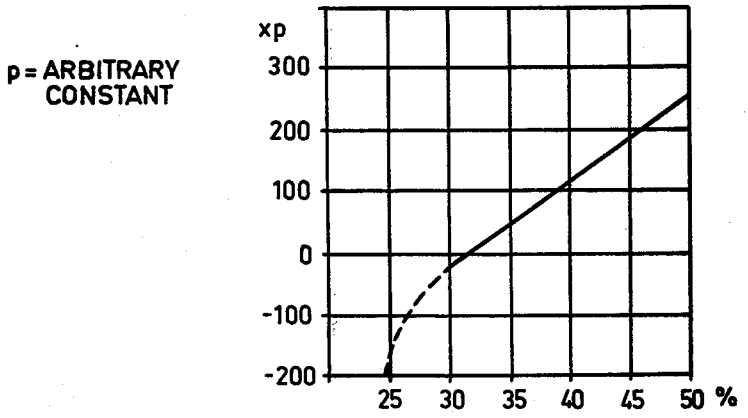
FIG. 2 is a graph showing the inward moment of force exerted by the upper leg of the mold beam as a function of the height of the stay member coupling point above the beam support, under the load of a flowable concrete mass occupying the entire mold cavity.

The graph in FIG. 2 schematically shows the magnitude of the inward moment of force exerted by the upper end of the mold beam when the mold cavity is completely filled with a fluid concrete mass, as a function of the height of the stay member above the beam support. The basic calculations were made under the assumption of the existence of a true hydraulic medium. It was found, however, that the calculations corresponded also to the behaviour of a flowable concrete mass. It appears from the graph that the moment of force equals zero when the height of the coupling point of the stay member is about 32.5% of the total height of the beam. Accordingly, this is the lowest allowable height of the coupling point since otherwise the moment of force would be directed outwards (the negative values in the graph). Preferably, the coupling point is positioned at so high a level on the beam that the upper leg of the beam is pressed against the distance member under a certain amount of prestress. Since the inward moment of force increases largely with increasing height, the coupling point preferably is located at a height which corresponds to 35–40% of the total effective height of the beam.

While particular embodiments and examples have been illustrated and described, modifications and changes will become apparent to those skilled in the art, and it is intended to cover in the appended claims all such modifications and changes that come within the spirit and scope of the invention.

What I claim is:

1. A mold element for casting concrete walls comprising a mold wall strengthened by an assembly of elongate strengthening members which extend substantially parallel to one another and to one edge of the mold wall, and having at least two mold beams extending transverse to said strengthening members and across the mold wall from said one edge thereof to the opposite edge, each of the mold beams being upright when the mold element is in a vertical orientation, with said one edge uppermost to form a mold, and each mold beam having one and only one coupling hole extending through the mold beam at which a stay member can be positioned to extend between the mold element and a corresponding opposed mold element to link them together to form a mold cavity between them, these stay members being the only means for restraining outward movement of the mold elements, said coupling hole being located at a position corresponding to 1/3 to forty percent of the length of the beam from the lower end thereof and a distance member arranged at the uppermost edge of the mold wall opposite each beam to engage the uppermost edge of the corresponding mold wall opposite a corresponding beam of an opposed mold element to prevent bending of the beams towards one another in the course of casting, but not preventing movement of the upper ends away from one another.

2. A mold element as claimed in claim 1, wherein said coupling hole is located at a position between 35 and 40% of the total length of the beam from the lower end thereof.

3. A mold element for casting concrete walls comprising, in combination:

a pair of rigid upright confronting spaced apart mold walls having corresponding mold beams on the outer surfaces of said walls extending from the upper to lower edges thereof, said mold walls being joined only by coupling means passing through corresponding beams with no more than one coupling means passing through each beam and the coupling means being positioned at a height of from one-third to forty percent of the height of said wall from the lower edge thereof;

distance means positioned above said coupling means with the ends of the distance means confronting the two inner surfaces of the mold walls so that the mold walls may not approach one another beyond a predetermined distance at the positions of said distance means but said distance means not preventing separation of the walls at the distance means; and the mold walls having no other means for restraining outward movement of said walls.

4. The mold element described in claim 3 wherein the coupling means is positioned at a distance from the lower edge of the mold walls of from 35% to 40% of the height of the walls.

5. The molding element described in claim 3 wherein the distance means is positioned at substantially the upper edge of the mold walls.

6. The molding element described in claim 3 wherein each coupling means comprises a bolt.

7. The molding element described in claim 3 wherein the distance means is secured to one mold wall.

* * * * *